United States Patent [19]

Uytterhoeven et al.

[11] Patent Number: 4,663,265

[45] Date of Patent: May 5, 1987

[54] LIQUID ELECTROPHORETIC DEVELOPER COMPOSITION

[75] Inventors: Herman J. Uytterhoeven, Bonheiden; August M. Mariën, Oevel; Walter F. De Winter, 's-Gravenwezel, all of Belgium

[73] Assignee: Agfa-Gevaert, N.V., Mortsel, Belgium

[21] Appl. No.: 889,383

[22] Filed: Jul. 25, 1986

[30] Foreign Application Priority Data

Sep. 10, 1985 [EP] European Pat. Off. ... EP85201431.5

[51] Int. Cl.[4] ..... G03G 9/12

[52] U.S. Cl. ..... 430/114; 430/115; 428/407

[58] Field of Search ..... 430/114, 115; 428/407

[56] References Cited

U.S. PATENT DOCUMENTS 3,427,258 2/1969 Trease ..... 430/107 X
3,770,637 11/1973 Okuno et al. ..... 430/114
3,900,412 8/1975 Kosel ..... 430/114
4,522,908 6/1985 de Winter et al. ..... 430/114

*Primary Examiner*—J. David Welsh
*Attorney, Agent, or Firm*—A. W. Breiner

[57] ABSTRACT

A liquid electrophoretic developer composition for developing electrostatic latent images, wherein pigment particles for obtaining improved dispersion stability in association with at least two polymers are dispersed in an electrically insulating non-polar carrier liquid having a volume resistivity of at least $10^9$ ohm.cm and a dielectric constant less than 3, characterized in that the composition comprises at least one polymer (hereafter called "polymer A") which forms a coating on the pigment particles and has a poor solubility in said liquid as determined by Test A herein described, and at least one polymer (hereafter called "polymer B") being chemically linked to the pre-coated polymer A, said polymer B having a good solubility in said liquid as determined by Test B herein described.

11 Claims, 2 Drawing Figures

LIQUID ELECTROPHORETIC DEVELOPER COMPOSITION

DESCRIPTION

Figure 1:
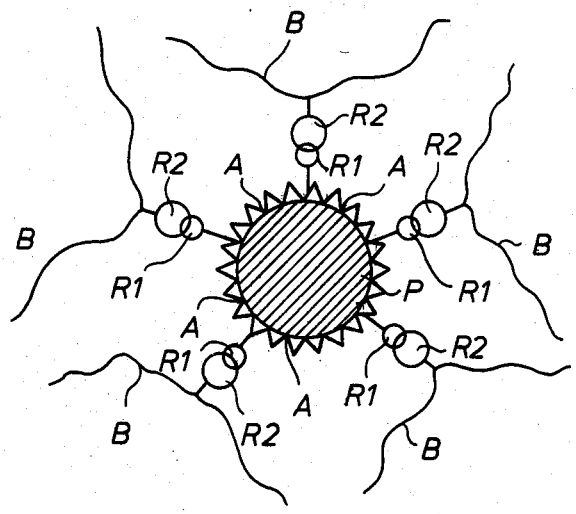

The present invention relates to an electrophoretic developer suited for the development of electrostatic charge patterns and the preparation of such developer.

In electrostatography an electrostatic image is made visible, i.e. developed, by charged toner particles.

In electrophotography an electrostatic image is obtained with an electrophotographic material typically comprising a coating of a photoconductive insulating material on a conductive support. Said coating is given a uniform surface charge in the dark and is then exposed to an image pattern of activating electromagnetic radiation such as light or X-rays. The charge on the photoconductive element is dissipated in the irradiated area to form an electrostatic charge pattern which is then developed with an electrostatically attractable marking material also called toner. The toner image may be fixed to the surface of the photoconductive element or transferred to another surface and fixed thereon. Instead of forming the electrostatic image by the steps described above it is also possible to charge directly a dielectric material in image configuration e.g. with a charged stylus, or through photo-electron emission or ionography.

Historically, a one-component dry powder toner was first used for developing electrostatic images. Other development processes, presently known as cascade, fur brush, powder cloud, magnetic brush and liquid electrophoretic development were introduced.

Developers of the electrophoretic type initially comprised basically a simple dispersion of a pigment but no binder. It was later proposed, e.g by Metcalfe and Wright, J. Oil colour Chem. Ass., 39 (1956) 851–853, to use liquid developers incorporating resins and control agents forming so-called "self-fixing" toners.

In liquid developers comprising coloured toner particles suspended in an insulating carrier liquid, the volume resistivity of the liquid is preferably in excess of $10^9$ Ohm.cm and has a dielectric constant below 3. The suspended toner particles, which usually comprise finely divided pigments (which expression includes organic dyes in pigment form), obtain an electric charge of a definite polarity by a so-called charge control agent and develop the latent image under influence of the charge of the latent electostatic image.

The charging of the toner particles can be achieved by the addition of oil-soluble ionogenic substances e.g. metallic salts of organic acids with sufficiently long aliphatic chains. By predominant adsorption of one ionic species the particles receive a net charge, the amount of which can be regulated simply by changing the additive concentration. The polarity is controlled by the appropriate choice of ionogenic substance. For example, a suspension of carbon black in liquid isoparaffins becomes positively charged by calcium diisopropyl salicylate and by the organic phosphorus compounds described in GB-P No. 1,151,141.

Negatively charged toner particles can be obtained by using as charge control agent overbased metal alkyl sulphonates (oil-soluble micelles of metal alkyl sulphonates with excess metal hydroxide or solubilized carbonates) as described in Proc. IEEE, Vol. 60, No. 4, April 1972, page 363 and GB-P No. 1,571,401.

The use of random, block or graft-copolymers in the preparation of a liquid developer for xerographic images has been described in GB-P No. 1,186,562. According thereto the liquid developer contains dispersed in the carrier liquid polymer particles comprising in admixture at least two compatible copolymers one less polar than the other, the more polar copolymer providing a field extending effect and the less polar copolymer serving to disperse the particles in the carrier liquid. The field extending effect may be attributed to the extension of the electric field by a transfer of the charges from the surface of the photoconductor through developer particles deposited previously.

The use of specific block copolymers as dispersion stabilizing agent has been described in the published European Patent Application No. 83200852.8. Said copolymer more particularly comprises a polymer part A being an adsorbent group for the pigment particles to be dispersed and at least one polymer part B that is solvatable by the carrier liquid, characterized in that polymer part A is a polystyrene chain having a number average molecular weight of at least 2,000, preferably between 2,000 and 6,000, and said part B is a polymethacrylate fatty alcohol ester chain having a number average molecular weight of at least 7,000, preferably at least 10,000.

Various methods for the preparation of block copolymers are described in Advances in Polymer Sci., 29, (1978) p. 85–157.

As is known to those skilled in the art the synthesis of block copolymers is a much more difficult process than the synthesis of random copolymers in which the different structural units are arranged in a purely random manner and so, where possible preference is given to random copolymers or homopolymers which promote the stability of the pigment dispersion.

It is an object of the present invention to provide a liquid electrophoretic developer containing in a carrier liquid a particularly stable dispersion of pigment particles carrying at least two polymers, one of which coats said particles and is substantially insoluble in said carrier liquid and the other of which is substantially soluble in said carrier liquid and is chemically linked to the said coating polymer while having a solvatable molecule part extending, i.e. dangling, in the carrier liquid.

According to the present invention there is provided a liquid electrophoretic developer composition for developing electrostatic latent images, which composition comprises pigment particles which in association with at least two polymers are dispersed in an electrically insulating non-polar carrier liquid having a volume resistivity of at least $10^9$ ohm.cm and a dielectric constant less than 3, characterised in that the composition comprises at least one polymer (hereafter called "polymer A") which forms a coating on the pigment particles and has a poor solubility in said liquid as determined by Test A hereafter described, and at least one polymer (hereafter called "polymer B") which is chemically linked to the or a said polymer A and which has a good solubility in said liquid as determined by Test B herafter described.

Figure 2:
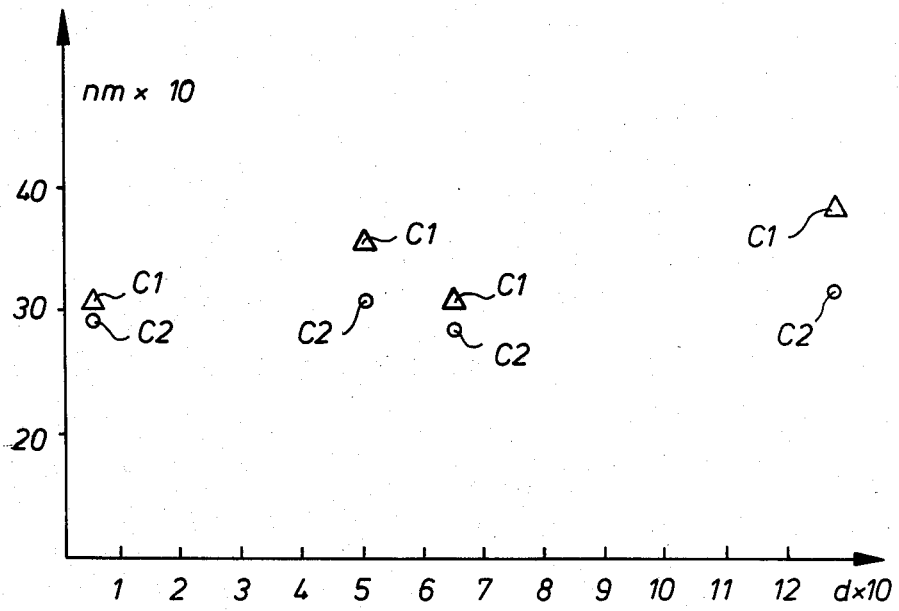

The present invention and its advantage are illustrated by FIGS. 1 and 2, of which:

FIG. 1 represents a pigment particle surrounded by polymers A and B as defined herein having chemically reactive groups $R_1$ and $R_2$ respectively, and FIG. 2 is a dispersion stability diagram (particle size versus storage time).

The polymer A which has been pre-coated on the pigment particles acts as an anchoring layer for the polymer B which being substantially soluble in the carrier liquid extends (dangles) therein with its solvatable molecule part and provides a steric barrier preventing toner particles from direct contact. So, the different polymers together confer on the toner developer a better shelf life stability by sterical hindrance.

The Tests A and B above referred to are as follows:

TEST A 2.5 g of the polymer to be tested is vigorously mixed at 20° C. with 100 ml of carrier liquid for a time sufficient to reach the equilibrium of dissolving. The resulting composition is centrifuged for 60 min at 34,000 G (G being the acceleration factor 9.8 $m/s^2$ for earth gravity). The polymer has the required poor solubility of a polymer A if 90% by weight of the polymer separates from the liquid.

TEST B 2.5 g of the polymer to be tested is vigorously mixed at 20° C. with 100 ml of carrier liquid for a time sufficient to reach the equilibrium of dissolving. The resulting composition is centrifuged for 60 min at 34,000 G (G being the acceleration factor 9.8 $m/s^2$ for earth gravity). The polymer has the required good solubility of a polymer B if not more than 10% by weight of the polymer separates from the liquid.

In carrying out the invention it is preferred to use at least one polymer A having such a poor solubility in the carrier liquid that at least 99% by weight of the polymer separates from the liquid under Test A above.

In carrying out the invention it is preferred to use at least one polymer B having such a good solubility in the carrier liquid that not more than 1% by weight of the polymer separates from the liquid under Test B above.

Polymers A complying with the above solubility test A preferably contain structural units derived from monomers being non-solvatable by the carrier liquid. Examples thereof are enumerated in the following List I.

LIST I (a) Ethylenically unsaturated carboxylic acid esters having in the ester group $C_1$–$C_4$ alkyl, $C_1$–$C_4$ haloalkyl, $C_1$–$C_4$ alkoxyalkyl, $C_1$–$C_4$ acylalkyl, $C_1$–$C_4$ cyanoalkyl, aralkyl, aryl or substituted aryl;
(b) ethylenically unsaturated carbonitriles,
(c) ethylenically unsaturated carbonamides and N-substituted carbonamides, e.g. $C_1$–$C_4$ alkyl or $C_1$–$C_4$ haloalkyl substituted carbonamides,
(d) halogenated aliphatically unsaturated hydrocarbons, e.g. vinyl chloride and vinylidene chloride,
(e) styrene, methylstyrene, methoxystyrene and halogenated styrene,
(f) vinyl alkyl ethers having from 1 to 4 carbon atoms in the alkyl group;
(g) vinyl ketones having an alkyl group of at most 4 carbon atoms,
(h) vinyl alcohol esters of aliphatic, araliphatic, aromatic or heterocyclic acids wherein alkyl, if present, is $C_1$–$C_4$ alkyl,
(i) vinyl acetals, e.g. polyvinyl butyral, and
(j) N-vinyl pyrrolidinone.

Particularly useful are e.g. ethyl acrylate, propyl acrylate, isobutyl acrylate, isobutyl methacrylate, vinyl acetate, vinyl propionate, vinyl butyrate and mixtures thereof.

Polymers B complying with the above solubility test B preferably contain structural units derived from non-ionic monomers being solvatable by the carrier liquid. Examples thereof are enumerated in the following List II.

LIST II (a) alkylstyrenes having from 3 to 10 carbon atoms in the alkyl group,
(b) alkoxystyrenes having from 3 to 10 carbon atoms in the alkyl group,
(c) alkyl acrylates and methacrylates having from 8 to 22 carbon atoms in the alkyl group,
(d) vinyl alkyl ethers having from 8 to 22 carbon atoms in the alkyl group,
(e) vinyl esters of alkanoic acids having from 6 to 22 carbon atoms in the alkyl group, and
(f) alkyl substituted polysiloxanes.

Preferred non-ionic hydrophobic solvatable monomers are: lauryl acrylate, lauryl methacrylate, hexadecyl methacrylate, octadecyl methacrylate, vinyl laurate, vinyl palmitate, vinyl stearate, vinyl eicosate and vinyl docosate.

In conjunction with structural units derived from non-solvatable monomers the polymer(s) A contain(s) at least one structural unit comprising a chemically reactive group capable of chemical reaction with a group present in at least one structural unit of the polymer(s) B.

Chemically reactive groups that may be present in structural units of polymers A and B are, e.g. groups capable of addition, elimination or condensation reactions. Examples thereof are:
(a) an alkaline group, e.g. primary, secondary or tertiary amino group or quaternary ammonium base group,
(b) an acidic group, e.g. carboxylic acid, sulphonic acid or phosphonic acid group,
(c) an epoxy group,
(d) an isocyanate group,
(e) an acid halide group,
(f) an acid anhydride group,
(g) a hydroxy or thiol group,
(h) an alkyl halide group,
(i) an active methylene group,
(j) a ketone or aldehyde group,
(k) an oxime group,
(l) an hydroxamic acid group, or
(m) a chloroformiate group.

Examples of monomer units containing an alkaline group are those having one of the following general formulae:

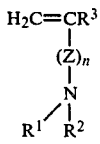

(A)

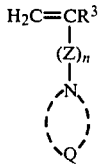

(B)

-continued (C)

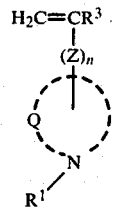

wherein:

each of $R^1$ and $R^2$ (same or different) represents hydrogen, an alkyl, a cycloalkyl, an aralkyl e.g. benzyl or an aryl group e.g. phenyl, $R^3$ is a hydrogen or $C_1$–$C_4$ alkyl, Q represents the atoms necessary to complete a 5- or 6-membered heterocyclic ring, Z is selected from the group consisting of —$R^4$—, —$COOR^4$—, —CONH—$R^4$—, —O—$COR^4$—, and —$CH_2$—OCO—$R^4$—, wherein $R^4$ is alkylene, arylene or arylenealkylene (e.g. benzylene) having from 1 to 20 carbon atoms, and n is 0 or 1.

The corresponding ammonium salts or bases of these monomers are described in U.S. Pat. No. 4,273,849 wherefrom they can be easily produced.

Specific alkaline monomers are:

tert.-butylaminoethyl methacrylate,
N,N-dialkylaminoethyl acrylate,
N,N-dialkylaminoethyl methacrylate,
N,N-dimethylaminopropyl methacrylamide,
methacrylamido-n-propylene-trimethylammonium hydroxide, and vinyl pyridine.

Examples of monomer units containing an acidic group are those within the scope of the following general formula:

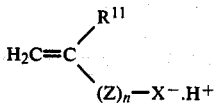

wherein:

$R^{11}$ represents hydrogen or alkyl, e.g. ($C_1$–$C_3$) alkyl, and

Z represents a bivalent organic group, e.g. a bivalent hydrocarbon group such as an alkylene group or an arylene group or represents a bivalent hydrocarbon group interrupted by one or more hetero-atoms, e.g. nitrogen and/or oxygen or interrupted by a —O—CO— group or is a bivalent —CONH-alkylene group, n represents zero or 1, and $X^-$ represents —$COO^-$, —$SO_3^-$, —$SO_4^-$, —$PO_4H^-$, —$PO_4R^-$, —$PO_3H^-$ or —$PO_3R^-$, wherein R is a hydrocarbon group.

Specific acidic monomers are:

acrylamido-hydroxyacetic acid,
acrylic acid,
methacrylic acid,
carboxyethyl acrylate,
crotonic acid,
itaconic acid,
vinyl benzoic acid,
vinylphenylacetic acid,
9(10)-acrylamidostearic acid,
monoallylphthalic acid,
sulphoethyl (meth)acrylate,
sulphopropyl (meth)acrylate,
sulphobutyl (meth)acrylate,
acrylamido-2-propane-sulphonic acid,
vinyl sulphonic acid, and
styrenesulphonic acid.

Several of the foregoing monomers in acid or salt form are described in U.S. Pat. Nos. 3,788,995, 4,171,275 or 4,229,513.

Examples of monomer units containing an epoxy group are:

allylglycidyl ether, and
glycidyl (meth)acrylate.

Examples of monomer units containing an isocyanate group are:

allyl isocyanate,
vinyl isocyanate,
isocyanatoethyl methacrylate.

Examples of monomer units containing an acid halide group are:

(meth)acrylic acid chloride,
styrene-m-sulphofluoride, and
styrene-p-sulphochloride.

Examples of monomer units containing an acid anhydride group are:

maleic acid anhydride,
itaconic acid anhydride,
citraconic acid anhydride, and
cis-3-methyl-tetrahydrophthalic acid anhydride.

Examples of monomer units containing a hydroxy group are:

allyl alcohol
2-butene-1,4-diol,
2-hydroxyethyl (meth)acrylate,
3-hydroxypropyl (meth)acrylate,
N-methylol-acrylamide, and
propyleneglycol mono(meth)acrylate.

A thiol containing unit as present e.g. in polyvinyl mercapto-acetate.

Examples of monomer units containing an alkyl halide group are:

allyl chloride,
allyl bromide,
Beta-chloroethyl (meth)acrylate,
Beta-bromoethyl (meth)acrylate,
vinylbenzyl chloride,
vinyl-Beta-chloroethyl ether,
Alpha-chloromethyl acrylate, and
bis-(Beta-chloroethyl) vinyl phosphonate.

An example of a monomer unit containing an active methylene group is: allyl acetoacetate.

Examples of monomer units containing an aldehyde or ketone group are:

(meth)acroleine,
diacetone acrylamide,
methylvinyl ketone, and
6-methyl-5-heptene-2-one.

Examples of monomer units containing an oxime group are the oximes of the above specified monomers containing an aldehyde or ketone group.

An example of a monomer containing a hydroxamic acid group is:

methacryloylhydroxamic acid.

An example of a monomer containing a formiate group is:

methacrylamidobenzene chloroformiate.

The chemically reactive groups may be distributed over the polymer chain at random or in a specific order or may be linked terminally thereto. Polymers containing one or more terminal chemically reactive groups such as a carboxylic acid group, hydroxyl group, amino group, substituted amino group, acid chloride group, epoxy group or isocyanate group can be prepared according to procedures described in GB-P No. 1,096,912. Polymers containing chemically reactive terminal groups may further be prepared by polycondensation reaction of interreactive difunctional compounds having functional groups capable of mutual reaction selected from the terminal groups listed above.

Structural units containing a chemically reactive group are preferably present in each of said polymers A and B in an amount of at least 1 percent by weight, e.g. between 5 and 20 percent by weight with respect to the total weight of the polymer.

In order to illustrate in detail the preparation of polymers A and B the following preparations are given.

PREPARATION 1 (polymer A)

Copolymerisation of isobutyl methacrylate and 2-sulphoethyl methacrylate.

In a pressure tube of 250 ml were introduced:

| | |
|---|---|
| 2-sulphoethyl methacrylate | 5 g |
| isobutyl methacrylate | 45 g |
| 2,2'-azo-diisobutyronitrile (ABN) | 250 mg |
| freshly distilled dioxan | 100 ml. |

Into the reaction mixture nitrogen was introduced and bubbled through for 10 minutes. Thereupon the pressure tube was sealed and heated to 70° C. at which temperature the copolymerisation proceeded for 16 h. Thereupon a further 100 mg of ABN were added and the polymerisation carried on for another 8 h at 70° C. After cooling to room temperature the copolymer was separated by precipitation in n-hexane and dried under vacuum conditions.

By titration 0.512 milliequivalent per gram (meq./g) of $—SO_3H$ was found, which indicates that 9.95 percent by weight of 2-sulphoethyl methacrylate groups are present in the copolymer.

PREPARATION 2 (polymer B)

Copolymerisation of stearyl methacrylate and dimethylaminoethyl methacrylate.

Preparation 1 was repeated with the difference that the following monomers were used in the indicated amounts:

| | |
|---|---|
| dimethylaminoethyl methacrylate | 5 g |
| stearyl methacrylate | 45 g |

The obtained copolymer was separated by precipitation in methanol.

By titration 0.682 meq./g of free amino was found, which indicates that 10.83 percent by weight of dimethylaminoethyl methacrylate groups are present in the copolymer.

PREPARATION 3 (polymer A)

Copolymerisation of isobutyl methacrylate and dimethylaminoethyl methacrylate.

Preparation 1 was repeated with the difference that the following monomers were used in the indicated amounts:

| | |
|---|---|
| dimethylaminoethyl methacrylate | 5 g |
| isobutyl methacrylate | 45 g |

The obtained copolymer was separated by precipitation in methanol.

By titration 0.632 meq./g of free amino was found, which indicates that 9.94 percent by weight of dimethylaminoethyl methacrylate groups are present in the copolymer.

PREPARATION 4 (polymer B)

Copolymerisation of stearyl methacrylate 2-sulphoethyl methacrylate.

Preparation 1 was repeated with the difference that the following monomers were used in the indicated amounts:

| | |
|---|---|
| 2-sulphoethyl methacrylate | 5 g |
| stearyl methacrylate | 45 g |

The obtained copolymer was separated by precipitation in water.

By titration 0.529 meq./g of free sulphonic acid was found, which indicates that 10.33 percent by weight of 2-sulphoethyl methacrylate groups are present in the copolymer.

PREPARATION 5 (polymer A)

Copolymerisation of isobutyl methacrylate and vinylbenzyl chloride.

Preparation 1 was repeated with the difference that the following monomers were used in the indicated amounts:

| | |
|---|---|
| vinylbenzyl chloride (60% m- and 40% p-) | 10 g |
| isobutyl methacrylate | 40 g |

The obtained copolymer was separated by precipitation in methanol.

The determined Cl-content was 1.354 meq./g, which indicates that 20.67 percent by weight of vinyl chloride groups are present in the copolymer.

PREPARATION 6 (polymer A)

Copolymerisation of methyl methacrylate and glycidyl methacrylate.

Preparation 1 was repeated with the difference that the following monomers were used in 100 ml of toluene:

| | |
|---|---|
| glycidyl methacrylate | 5 g |
| methyl methacrylate | 45 g |

The obtained copolymer was separated by precipitation in methanol.

PREPARATION 7 (polymer B)

Copolymerisation of stearyl methacrylate and methacrylic acid.

Preparation 1 was repeated with the difference that the following monomers were used in 100 ml of toluene:

| | |
|---|---|
| methacrylic acid | 5 g |
| stearyl methacrylate | 45 g |

The obtained copolymer was separated by precipitation in methanol.

PREPARATION 8 (polymer A)

Copolymerisation of methyl methacrylate and isocyanatoethyl methacrylate.

Preparation 1 was repeated with the difference that the following monomers were used in 100 ml of toluene:

| | |
|---|---|
| isocyanatoethyl methacrylate | 5 g |
| methyl methacrylate | 45 g |

The obtained copolymer was separated by precipitation in methanol.

PREPARATION 9 (polymer B)

Copolymerisation of stearyl methacrylate and 2-hydroxyethyl methacrylate.

Preparation 1 was repeated with the difference that the following monomers were used in 100 ml of toluene:

| | |
|---|---|
| 2-hydroxyethyl methacrylate | 5 g |
| stearyl methacrylate | 45 g |

The obtained copolymer was separated by precipitation in methanol.

PREPARATION 10 (polymer A)

Copolymerisation of methyl methacrylate and diethylaminoethyl methacrylate. Preparation 1 was repeated with the difference that the following monomers were used in 100 ml of toluene:

| | |
|---|---|
| diethylaminoethyl methacrylate | 10 g |
| methyl methacrylate | 40 g |

The obtained copolymer was separated by precipitation in methanol.

By titration 0.991 meq./g of free amino was found, which indicates that 18.37 percent by weight of diethylaminoethyl methacrylate groups are present in the copolymer.

PREPARATION 11 (polymer B)

Copolymerisation of stearyl methacrylate and vinylbenzyl chloride.

Preparation 1 was repeated with the difference that the following monomers were used in the indicated amounts:

| | |
|---|---|
| vinylbenzyl chloride (60% m- and 40% p-) | 5 g |
| stearyl methacrylate | 45 g |

The obtained copolymer was separated by precipitation in methanol.

The determined Cl-content was 0.676 meq./g, which indicates that 10.32 percent by weight of vinyl chloride groups are present in the copolymer.

The present invention includes a process for the preparation of a liquid electrophoretic developer containing pigment particles dispersed in an electrically insulating non-polar organic carrier liquid having a volume resistivity of at least $10^9$ ohm.cm and a dielectric constant less than 3, characterised in that said process comprises the following steps (1), (2) and (3):

Step (1): the pigment particles are pre-coated from a solution or melt with a polymer (hereafter called "polymer A") having a poor solubility in the carrier liquid as determined by Test A described herein, Step (2): the coated pigment particles resulting from Step (1) are dispersed in a carrier liquid medium, and Step (3) the dispersion formed by Step (2) is mixed with dissolved polymer (hereafter called "polymer B") which has a good solubility in the carrier liquid as determined by Test B described herein, and polymer B is chemically linked to polymer A being pre-coated on said pigment particles.

The pre-coating from a solution proceeds by mixing polymer A in dissolved form in an organic solvent wherein the pigment particles are present preferably already in dispersed state and evaporating the solvent leaving the polymer A coated to the pigment particles. The pre-coating of the pigment particles with polymer from the melt proceeds, e.g. by mixing in a kneader whereupon the mixture is solidified and ground.

According to an embodiment a step (4) is added wherein the pigment particles and associated polymers are separated from their carrier liquid in order to remove still dissolved non-reacted polymer B and are redispersed in a fresh quantity of carrier liquid.

The separation of the pigment particles carrying reacted polymers A and B from still dissolved polymer B can be effected, e.g. by sedimentation, centrifugation or filtration. The redispersing of the toner particles can be accomplished, e.g. by ultra-sound, high speed mixing apparatus or ball mill.

Solvents suitable for dissolving polymer A in step (1) are, e.g. polar solvents having a relatively low boiling point (preferably below 90° C.) such as acetone, butanone, methylene chloride, methanol, ethanol, isopropanol or toluene.

A good dispersion stability can often be obtained even with small amounts of polymers A and B e.g. when using said polymers in an amount of 0.020 per g of dry pigment particles. Optimal amounts for each pigment can be determined by simple tests.

The carrier liquid may be any kind of electrically insulating non-polar, fat-dissolving solvent. Said liquid is preferably a hydrocarbon liquid e.g. an aliphatic hydrocarbon such as hexane, cyclohexane, iso-octane, heptane or isododecane, a fluorocarbon or a silicone oil. Thus, the insulating liquid is e.g. isododecane or a commercial petroleum distillate, e.g. a mixture of aliphatic hydrocarbons preferably having a boiling range between 150° C. and 220° C. such as the ISOPARS G, H, K and L (trade marks) of Exxon and SHELLSOL T (trade mark) of the Shell Oil Company.

The pigment substance used in the toner particles may be any inorganic or organic pigment (said term including carbon), including such pigmenst that are already pre-coated with a resin which is insoluble in the carrier liquid, e.g. pigments pre-coated with a styrene-allyl alcohol copolymer described in U.S. Pat. No. 4,161,453.

Preferred black pigments consist of or contain carbon black, e.g. pre-coated with resin. The terminology "carbon black" includes lamp black, channel black and furnace black.

Examples of organic pigment dyes are e.g. phthalocyanine dyes, e.g. copper phthalocyanines, metal-free phthalocyanine, water insoluble azo dyes and metal complexes of azo dyes.

The following dyes in pigment form are given for illustration purposes only: FANALROSA B Supra Pulver (trade-name of Badische Anilin & Soda-Fabrik AG, Ludwigshafen, Western Germany), HELIOGENBLAU LG (trade-name of BASF for a metal-free phthalocyanine blue pigment), MONASTRAL BLUE (a copper phthalocyanine pigment, C.I. 74, 160). HELIOGENBLAU B Pulver (trade-name of BASF), HELIOECHTBLAU HG (trade-name of Bayer AG, Leverkusen, Western Germany, for a copper phthalocyanine (C.I. 74,160), BRILLIANT CARMINE 6B (C.I. 18,850) and VIOLET FANAL R (trade-name of BASF, C.I. 42,535).

Typical inorganic pigments include black iron(III) oxide and mixed copper(II) oxide/chromium(III) oxide/iron(III) oxide powder, milori blue, ultramarine cobalt blue and barium permanganate. Further are mentioned the pigments described in the French Pat. Nos. 1,394,061 filed Dec. 23, 1963 by Kodak Co., and 1,439,323 filed Apr. 24, 1965 by Harris Int. Corp.

The carbon blacks PRINTEX 140 and PRINTEX G (trade names of DEGUSSA-Frankfurt/M, W. Germany).) are preferably used in the developer. The characteristics of said carbon blacks are listed in the following Table.

TABLE

| | PRINTEX 140 | PRINTEX G |
|---|---|---|
| origin | channel black | furnace black |
| density | 1.8 g · cm$^{-3}$ | 1.8 g · cm$^{-3}$ |
| grain size before entering the developer | 29 nm | 51 nm |
| oil number (g of linseed oil adsorbed by 100 g of pigment) | 360 | 250 |
| specific surface (sq · m per g) | 96 | 31 |
| volatile material % by weight | 6 | 2 |
| pH | 5 | 8 |
| colour | brown-black | blue-black |

As colour corrector for the PRINTEX pigments preferably a minor amount of copper phthalocyanine is used, e.g. from 1 to 20 parts by weight with respect to the carbon black.

In contrast to dry toners the liquid suspended toner particles acquire normally their negative or positive charge from a chemical dissociation reaction on the toner particle surface and the introduction of a charged species in the carrier liquid to form the counterion. The principal charging mechanisms operating with a dissociation reaction are described e.g. by Robert B. Comizolli et al. in Proceedings of the IEEE, Vol. 60, No. 4, April 1972, p. 363–364.

For a given charge density of the charge-carrying surface the maximum development density attainable with toner particles of a given size is determined by the charge/toner particle mass ratio, which is determined substantially by an amount of ionic electrical polarity controlling substance employed.

In a liquid developer composition according to the present invention the charge control of the pigment particles may stem from ionic groups belonging to polymers A and/or B so that such polymer(s) serve also as charge control substance(s).

The charge control substance(s) may have positive or negative charging effect. Mostly oil-soluble inonogenic substances (surfactants) e.g. metallic salts of organic acids with long aliphatic chain (e.g. containing at least 6 carbon atoms) are used for charge control. By predominant adsorption of one ionic species the toner particles receive a net charge whose amount can be regulated by changing the additive concentration. A charge control agent, if applied, may be added e.g. during one of the already mentioned steps (1) to (4) or following step (4). In this way the sensitivity of the toner (i.e. deposited mass per surface charge) can be controlled. The polarity can be determined by appropriate choice of the surfactant. For example, a suspension of carbon black in liquid isoparaffins becomes negatively charged by overbased calcium petroleum sulphonate and positively charged by calcium diisopropyl salicylate. Mixtures of different charge control agents can be used. For example a mixture of different charge control agents having opposite charging effects can be used so that the strength of the charge on the toner or the polarity thereof can be adjusted by varying the ratio between the different agents (see U.K. Patent Specification Nos. 1,411,287–1,411,537 and 1,411,739, all filed July 12, 1972 by Agfa-Gevaert N.V.). Particularly suitable positively working charge control agents are described in the United Kingdom Patent Specification 1,151,141 filed Feb. 4, 1966 by Gevaert-Agfa N.V. These agents are bivalent or trivalent metal salts of:

(a) a monoester or diester of an oxyacid derived from phosphorus,
(b) an oxyacid derived from phosphorus and containing one or two organic groups linked to the phosphorus atom by a carbon atom, or
(c) an oxyacid derived from phosphorus and containing an ester group and an organic group linked by a carbon atom to the phosphorus atom, said organic group being aliphatic, cycloaliphatic or aromatic.

The or each organic group of agents (b) and (c) above is preferably a chain of at least 4 carbon atoms, most preferably from 10 to 18 carbon atoms, and such chain may be substituted and/or interrupted by hetero-atoms, e.g., oxygen, sulphur, or nitrogen atom(s).

Particularly good results are obtained with the zinc salts. However, other salts may likewise be used e.g. magnesium salts, calcium salts, strontium salts, barium salts, iron salts, cobalt salts, nickel salts, copper salts, cadmium salts, aluminium salts and lead salts.

The solubility in the electrically insulating carrier liquid of such metal salts can be promoted by the presence of one or more organic groups with branched structure, e.g. branched aliphatic groups, such as a 2-butyl-octyl group.

Other particularly suitable positively working charge control agents that are of special interest in the production of an electrophoretic developer with low charge/toner particle mass ratio are the metal alkyl sulphonates described in the United Kingdom Patent Specification No. 1,571,401 filed Sept. 16, 1975 by Agfa-Gevaert N.V.

Still other suitable positively working charge control agents are described in the published European Patent Application No. 83 2000 85.5 filed Jan. 20, 1983 by Agfa-Gevaert N.V.

A liquid developer composition according to the present invention can be prepared by using dispersing and mixing apparatus well known in the art. It is conventional to use, e.g. a 3-roll mill, ball mill, colloid mills, high speed stirrers and ultra-sound generators.

The toner developer is usually prepared in a concentrated form and diluted in the copying apparatus before actual use. Such concentrated toner, called pre-mix contains the toner particles normally in a concentration of 5 to 80% by weight of solids with respect to the carrier liquid. It is generally suitable for a ready to use electrophoretic liquid developer to incorporate the toner in an amount between 0.3 g and 20 g per liter, preferably between 1 g and 10 g per liter.

The electrophoretic development may be carried out using any known electrophoretic development technique or device. The field of the image to be developed may be influenced by the use of a development electrode. The use of a development electrode is of particular value in the development of continuous tone images. When no development electrode is used, the developed image may exhibit exaggerated density gradients which may be of interest e.g. in certain medical X-ray images for diagnostic purposes.

The following examples illustrate the present invention.

All parts, ratios and percentages are by weight unless otherwise stated.

EXAMPLE 1

Step (1): 16 g of carbon black PRINTEX G (trade name) were added to a solution in 350 ml of acetone of 4 g of the copolymer of isobutyl methacrylate and 2-sulphoethyl methacrylate (polymer A) prepared according to preparation 1. The mixture was stirred for 24 h and treated with ultrasound for 10 minutes for obtaining a very homogeneous distribution of the carbon black in the solution. The acetone was evaporated using a rotary evaporator and the obtained solid mass was dried under vacuum.

Step (2): the dry solid residue (about 20 g) was ground in a mortar in order to obtain a fine powder which was further ground in a 1-liter vibrating ball mill in the presence of 12.6 g of the copolymer of isobutyl methacrylate, stearyl methacrylate and methacrylic acid (75/24.8/0.2), called herein NEO polymer, as dispersing agent and 240 ml of isododecane. To 250 ml of the obtained dispersion 250 ml of isododecane were added.

Step (3): 8.8 g of the copolymer of stearyl methacrylate and dimethylaminoethyl methacrylate (polymer B) prepared according to preparation 2 were dissolved in 500 ml of isododecane. To the obtained solution containing polymer B the above prepared dispersion containing said polymer A was added portionwise in a high speed mixer and ultrasound was used intermittently over a period of 30 minutes. After the addition the mixture was stirred for a further hour to have the reaction of polymer A with polymer B practically completed.

A part (1) of the dispersion was diluted with isododecane in order to obtain a pre-mix (I) containing about 0.3 g of carbon black per liter.

Step (4): another part (2) of the dispersion was subjected to centrifuging at 9,000 rpm for 30 minutes in order to separate the solid toner particles carrying polymers A and B and remove unreacted polymer B. The solid toner particles were redispersed in pure isododecane in order to obtain a pre-mix (II) containing 0.3 g of carbon black per liter. The change of the particle size in the toner dispersions obtained from pre-mix (I) and (II) respectively was monitored over a period of 125 days. In the accompanying FIG. 2 is represented how their average particle size diameter in (nm) varies versus time in days (d).

From said FIG. 2 can be learned that the carbon black dispersions obtained from pre-mix (I) (points marked C1) and from pre-mix (II) (points marked C2) contain toner particles that are practically invariable in size with time, which means that no particle aggregation takes place and dispersion stability is very high.

The average diameter (average particle size) of the toner particles was measured with the COULTER (trade-mark) NANO-SIZER. The measuring principles used in this instrument are those of Brownian motion and autocorrelation spectroscopy of scattered laser light. The frequency of this Brownian motion is inversely related to particle size.

EXAMPLES 2–3

Example 1 was repeated with the difference, however, that to two equal parts of the pre-mix dispersion (II) were added respectively 4.8 mg and 14 mg of zinc mono-2-butyl-octyl phosphate as charge controlling agent (CCA); such means that 1.6 and 4.6% by weight of charge controlling agent were used respectively with respect to pigment (P). The pigment obtains hereby a positive charge.

The average toner particle size (APS) did not show a substantial change over a 22-day period.

The $Q_T$ value expressed in coulomb (C) being a measure for the charging of the toner particles was increasing in direct relationship to the amount of charge controlling agent (see Table 1).

The mobility (My) expressed in $m^2/V.s$ was measured in a micro-electrophoresis cell and is a measure for the Zeta-potential according to the equation:

$$My = Zeta.Epsilon/6.pi.Eta$$

wherein: Epsilon is the permittivity of the electrolyte medium, pi is 3.1416 . . . , and Eta is the Stokes' viscosity. The mobility is a measure of the deposition speed of the toner particles. The plus (+) sign indicates that the toner particles have moved towards the positively charged electrode.

TABLE 1

| CCA % to P | $Q_T$ | My | APS (nm) Start | APS (nm) After 22 days |
|---|---|---|---|---|
| 1.6 | $+12 \cdot 10^{-8}$ | $+3.4 \cdot 10^{-10}$ | 268 | 297 |
| 4.6 | $+30 \cdot 10^{-8}$ | $+6.5 \cdot 10^{-10}$ | 282 | 254 |

The $Q_T$ value was obtained as follows:

"An electrophoresis cell having two planar electrodes each with a surface of 20 $cm^2$ spaced at a distance of 0.15 cm was filled with the above electrophoretic toner dispersions of which 4 ml were diluted with 1 liter of isododecane. The electric current (I) flowing between the two electrodes at a voltage puls of 500 V for 0.5 s was measured."

The current (I) is the result of a charge (Q) transport due to the inherent conductivity of the liquid per se and of the electrophoretic toner particle displacement towards one of the electrodes and the movement of its counter ions towards the other electrode. The toner-deposition (blackening) of the negative electrode (cathode) proves that the toner particles are positively charged. The $Q_T$ value which is expressed in coulomb (C) is the current I in amperes integrated over the period (t) of 0.5 s and is a measure of the charging of the toner particles.

The obtained electrophoretic toner proved to be suited for the positive development of negatively charged areas (−300 V) of a photoconductive recording material containing photoconductive zinc oxide.

EXAMPLE 4

Step (1): 1 part by weight of carbon black pigment particles PRINTEX G (trade name) was mixed at 120° C. with 2 parts by weight of a styrene-allyl alcohol resin (hydroxyl content 5.5% and average molecular weight 1,600). The pigment-resin aggregate obtained on cooling was milled in dry state at 20° C. to obtain again a particulate material (powder). 16 g of said particulate material were added to 200 ml of methanol wherein 2 g of the copolymer of isobutyl methacrylate and 2-sulphoethyl methacrylate (polymer A) prepared according to preparation 1 were dissolved. The mixture was milled for 15 h in a vibratory ball-mill. The methanol was evaporated using a rotary evaporator and the obtained solid mass was dried under vacuum.

Step (2): the dried solid residue (about 17 g) was ground in a mortar in order to obtain a fine powder which was further ground in a 1-liter vibratory ball mill in the presence of 12.6 g of NEO polymer and 240 ml of isododecane. To 250 ml of the obtained dispersion 250 ml of isododecane were added.

Step (3): 4.4 g of the copolymer of stearyl methacrylate and dimethylaminoethyl methacrylate (polymer B) prepared according to preparation 2 were dissolved in 500 ml of isododecane. To the obtained solution of polymer B the above prepared dispersion containing said polymer A was added portionwise in a high speed mixer and ultrasound was used intermittently over a period of 30 minutes. After the addition the mixture was stirred for still 30 minutes to have the reaction of polymer A with polymer B completed.

A part (1) of the obtained dispersion was diluted with isododecane in order to obtain a pre-mix (I) containing about 0.3 g of carbon black per liter.

Step (4): another part (2) of the dispersion was subjected to centrifuging at 9,000 rpm for 45 minutes in order to separate the solid toner particles carrying polymers A and B and removing unreacted polymer B. The solid toner particles were redispersed in pure isododecane in order to obtain a pre-mix (II) containing 0.3 g of carbon black per liter.

The change of the average particle size (APS) in the toner dispersions obtained from pre-mix (I) and (II) respectively was monitored over a period of 40 days. The results with respect to the change in particle size, the $Q_T$ value and the My value are listed in the following Table 2.

TABLE 2

| PREMIX | $Q_T$ | My | APS (nm) Start | APS (nm) After 40 days |
|---|---|---|---|---|
| I | $-9 \cdot 10^{-8}$ | $-5.3 \cdot 10^{-10}$ | 192 | 268 |
| II | $-4 \cdot 10^{-8}$ | $-6 \cdot 10^{-10}$ | 237 | 208 |

The obtained electrophoretic toner proved to be suited for the reversal development of negatively charged areas (−300 V) of a photoconductive recording material containing photoconductive zinc oxide.

EXAMPLES 5–8

Example 4 was repeated with the difference, however, that to equal parts of the pre-mix dispersion (II) were added respectively 1.1 mg, 3.75 mg, 7.5 mg and 15 mg of zinc mono-2-butyl-octyl phosphate as charge controlling agent (CCA). Hereby 0.375%, 1.25%, 2.5% and 5% of CCA were present with respect to the pigment (P).

The average toner particle size (APS) did not show a substantial change over a 50-day period.

The $Q_T$ value which is a measure of the charging of the toner particles was increased in direct relationship to the amount of charge controlling agent (see Table 3). The toner particles were negatively charged as indicated by the charge sign of the mobility My.

TABLE 3

| CCA % to P | $Q_T$ | My | APS (nm) Start | APS (nm) After 50 days |
|---|---|---|---|---|
| 0.375 | $-11 \cdot 10^{-8}$ | $-6.9 \cdot 10^{-10}$ | 229 | 164 |
| 1.25 | $-20 \cdot 10^{-8}$ | $-8.17 \cdot 10^{-10}$ | 186 | 171 |
| 2.50 | $-33 \cdot 10^{-8}$ | $-6.07 \cdot 10^{-10}$ | 203 | 157 |
| 5.00 | $-55 \cdot 10^{-8}$ | $-3.74 \cdot 10^{-10}$ | 215 | 176 |

The obtained electrophoretic toner proved to be suited for the reversal development of negatively charged areas (−300 V) of a photoconductive recording material containing photoconductive zinc oxide.

EXAMPLE 9

Step (1) of Example 4 was repeated with the difference that a polymer A was used prepared according to preparation 3. 2 g of said polymer A were dissolved in 250 ml of isopropanol and mixed in a vibratory ball mill together with 16 g of the milled carbon black powder which had been pre-coated with styrene-allyl alcohol resin (hydroxyl content 5.5% and average molecular weight 1,600) as described in Example 4. The isopropanol was evaporated using a rotary evaporator and the obtained solid mass was dried under vacuum.

Step (2) was the same as in Example 4.

Step (3) of Example 4 was repeated with the difference that a polymer B was used prepared according to preparation 4. 5.62 g of said polymer B were dissolved in 500 ml of isododecane and the procedure for preparing the toner dispersion was executed as in Example 4.

Step (4): was the same as in Example 4 and the dispersion was subjected to centrifuging at 9,000 rpm for 45 minutes in order to separate the solid toner particles carrying polymers A and B and removing unreacted polymer B. The solid toner particles were redispersed in pure isododecane in order to obtain a pre-mix containing 0.3 g of carbon black per liter.

The change of the average particle size (APS) of said pre-mix was at the start 169 nm and after 32 days was 192 nm.

EXAMPLES 10–13

Example 9 was repeated with the difference, however, that to the pre-mix increasing amounts of zinc mono-2-butyl-octyl phosphate as charge controlling agent (CCA) indicated in the following Table 4 with respect to the pigment (P) were added.

The $Q_T$ value which is a measure of the charging of the toner particles increased in direct relationship to the amount of charge controlling agent. The toner particles were positively charged as indicated by the charge sign of the mobility My.

TABLE 4

| CCA % to P | $Q_T$ | My |
|---|---|---|
| 0.375 | $+47 \cdot 10^{-8}$ | $+4.08 \cdot 10^{-10}$ |
| 1.25 | $+84 \cdot 10^{-8}$ | $+5.29 \cdot 10^{-10}$ |
| 2.50 | $+91 \cdot 10^{-8}$ | $+5.38 \cdot 10^{-10}$ |
| 5.00 | $+105 \cdot 10^{-8}$ | $+5.28 \cdot 10^{-10}$ |

The obtained electrophoretic toner proved to be suited for the positive development of negatively charged areas (−300 V) of a photoconductive recording material containing photoconductive zinc oxide.

EXAMPLE 14

Step (1) of Example 1 was repeated with the difference that a polymer A was used prepared according to preparation 3. 2 g of said polymer A were dissolved in 250 ml of acetone and mixed in a vibratory ball-mill together with 16 g of carbon black powder.

In step (2) the carbon black coated with polymer A (about 17 g) was milled in a vibratory ball mill together with 12.6 g of the already mentioned dispersing agent NEO, and 2 g of zinc mono-2-butyl-octyl phosphate as charge control agent in 240 ml of isododecane.

In step (3) a polymer B was used prepared according to preparation 4. 5.64 g of polymer B were dissolved in 500 ml of isododecane and allowed to react with polymer A forming a pre-coating on the carbon black particles.

Step (4) was the same as step (4) in Example 1. Following step (4) a pre-mix was prepared by dilution of the toner concentrate with isododecane in order to obtain a toner developer liquid containing 0.3 g of carbon black per liter.

The change of the average particle size (APS) of the toner of said pre-mix was monitored over a period of 60 days. The results with respect to charging and the change in particle size are given in the following Table 5.

TABLE 5

| PREMIX | $Q_T$ | My | APS (nm) Start | APS (nm) After 60 days |
|---|---|---|---|---|
| | $+24 \cdot 10^{-8}$ | $+6.7 \cdot 10^{-10}$ | 201 | 196 |

The obtained electrophoretic toner proved to be suited for the positive development of negatively charged areas (−300 V) of a photoconductive recording material containing photoconductive zinc oxide.

EXAMPLE 15

Step (1): 16 g of carbon black PRINTEX G (trade name) were added to a solution in 250 ml of acetone of 2 g of the copolymer of isobutyl methacrylate and vinylbenzyl chloride (polymer A) prepared according to preparation 5. The mixture was stirred for several hours and treated three times during 10 minutes with ultrasound to obtain a very homogeneous distribution of the carbon black in the solution. The acetone was evaporated using a rotary evaporator and the obtained solid mass was dried under vacuum.

Step (2): the dry solid residue (about 18 g) was ground in a mortar in order to obtain a fine powder which was further ground in a 1-liter vibrating ball mill in the presence of 12.6 g of the already mentioned dispersing agent NEO and 240 ml of isododecane. To 250 ml of the obtained dispersion 250 ml of isododecane were added.

Step (3): 12 g of the copolymer of stearyl methacrylate and dimethylaminoethyl methacrylate (polymer B) prepared according to preparation 2 were dissolved in 500 ml of isododecane. To the obtained solution containing polymer B the above prepared dispersion containing said polymer A was added portionwise in a high speed mixer and ultrasound was used intermittently over a period of 30 minutes. After the addition the mixture was stirred for another hour at 80° C. to have the reaction of polymer A with polymer B practically completed.

A part (1) of the obtained dispersion was diluted with isododecane in order to obtain a pre-mix (I) containing about 0.3 g of carbon black per liter.

Step (4): another part (2) of the dispersion was subjected to centrifuging at 9,000 rpm for 30 minutes in order to separate the solid toner particles carrying polymers A and B and remove unreacted polymer B. The solid toner particles were redispersed in pure isododecane in order to obtain a pre-mix (II) containing 0.3 g of carbon black per liter.

The change of the particle size in the toner dispersions obtained from pre-mix (I) and (II) respectively was monitored over a period of 12 days. The results with respect to the change in average particle size (APS) and the $Q_T$ value are listed in the following Table 6.

TABLE 6

| PREMIX | $Q_T$ | APS (nm) Start | APS (nm) After 12 days |
|---|---|---|---|
| I | $-7 \cdot 10^{-8}$ | 290 | 190 |
| II | $-4 \cdot 10^{-8}$ | 153 | 159 |

The obtained electrophoretic toner proved to be suited for the reversal development of negatively charged areas (−300 V) of a photoconductive recording material containing photoconductive zinc oxide.

EXAMPLES 16–19

Example 15 was repeated with the difference, however, that to the pre-mix dispersion (II) different amounts of zinc mono-2-butyl-octyl phosphate as charge controlling agent (CCA) with respect to the pigment (P) were added as indicated in Table 7.

By adding increasing amounts of charge controlling agent as shown in said Table 7 the sign of the charge polarity reverses and becomes positive. At the lower concentrations of charge controlling agent only a part of the toner particles shows a positive charge so that mobility (My) is found to be bipolar.

TABLE 7

| CCA % to P | $Q_T$ | My |
|---|---|---|
| 0.375 | $-3 \cdot 10^{-8}$ | bipolar |
| 1.25 | $+7 \cdot 10^{-8}$ | bipolar |
| 2.50 | $+12 \cdot 10^{-8}$ | $+2.8 \cdot 10^{-10}$ |
| 5.0 | $+20 \cdot 10^{-8}$ | $+2.2 \cdot 10^{-10}$ |

The obtained positively charged electrophoretic toner proved to be suited for the positive development of negatively charged areas (−300 V) of a photoconductive recording material containing photoconductive zinc oxide.

EXAMPLE 20

Step (1) of Example 1 was repeated with the difference that a polymer A was used prepared according to preparation 6.

Step (2) was the same as in Example 1.

Step (3) of Example 1 was repeated with the difference that a polymer B was used prepared according to preparation 7. A solution of 3.5 g of polymer B in 500 ml of isododecane was heated to 80° C. At that temperature and while stirring vigorously the dispersion containing carbon black particles pre-coated with polymer A according to step (1) was added dropwise to the solution of polymer B and the reaction between said two polymers was allowed to proceed for 30 minutes at 80° C. In the next step the dispersion was cooled to room temperature (20° C.) while being stirred.

Before and after step (4) the dispersion was diluted with isododecane in order to obtain a pre-mix (I) and a pre-mix (II) each containing 0.3 g of carbon black per liter.

The change of the average particle size (APS) in the toner dispersions obtained from pre-mix (I) and (II) was monitored over a period of 14 days. The results with respect to $Q_T$ value and the change in particle size (APS) are given in the following Table 8.

TABLE 8

| PREMIX | $Q_T$ | APS (nm) Start | APS (nm) After 14 days |
|---|---|---|---|
| I | $-2 \cdot 10^{-8}$ | 273 | 267 |
| II | $-1.5 \cdot 10^{-8}$ | 359 | 390 |

EXAMPLES 21–24

Example 20 was repeated with the difference, however, that to the pre-mix dispersion (II) different amounts of zinc mono-2-butyl-octyl phosphate as charge controlling agent (CCA) with respect to the pigment (P) were added as indicated in Table 9. The pigment thereby obtained a positive charge.

TABLE 9

| CCA % to P | $Q_T$ | My |
|---|---|---|
| 0.375 | $+6 \cdot 10^{-8}$ | $+10.07 \cdot 10^{-10}$ |
| 1.25 | $+7 \cdot 10^{-8}$ | $+9.20 \cdot 10^{-10}$ |
| 2.50 | $+8 \cdot 10^{-8}$ | $+8.50 \cdot 10^{-10}$ |
| 5.0 | $+10 \cdot 10^{-8}$ | $+7.50 \cdot 10^{-10}$ |

The obtained positively charged electrophoretic toner proved to be suited for the positive development of negatively charged areas (−300 V) of a photoconductive recording material containing photoconductive zinc oxide.

EXAMPLE 25

Step (1) of Example 20 was repeated with the difference that a polymer A was used prepared according to preparation 8.

Step (2) was the same as in Example 20.

Step (3) of Example 20 was repeated with the difference that a polymer B was used prepared according to preparation 9. 5 g of polymer B in 500 ml isododecane were used.

The dispersion was diluted with isododecane in order to obtain a pre-mix containing about 0.3 g of carbon black per liter.

The change of the average particle size (APS) in the toner pre-mix was monitored over a period of 11 days. At the start the APS value was 220 nm and after 11 days it was 321 nm.

EXAMPLE 26

Step (1) of Example 20 was repeated with the difference that a polymer A was used prepared according to preparation 10.

Step (2) was the same as in Example 20.

Step (3) of Example 20 was repeated with the difference that a polymer B was used prepared according to preparation 11. 10 g of polymer B in 500 ml of isododecane were used.

Before and after step (4) the dispersion was diluted with isododecane in order to obtain a pre-mix (I) and pre-mix (II) each containing 0.3 g of carbon black per liter.

The change of the average particle size in the toner dispersions obtained from pre-mix (I) and (II) respectively was monitored over a period of 14 days. The results with respect to the change in average particle size (APS) are listed in the following Table 10.

TABLE 10

| PREMIX | Particle diameter (nm) Start | Particle diameter (nm) After 14 days |
|---|---|---|
| I | 481 | 337 |
| II | 435 | 422 |

We claim:

1. A liquid electrophoretic developer composition for developing electrostatic latent images, which composition comprises pigment particles which in association with at least two polymers are dispersed in an electrically insulating non-polar carrier liquid having a volume resistivity of at least $10^9$ ohm.cm and a dielectric constant less than 3, characterised in that the composition comprises at least one polymer (hereafter called "polymer A") which forms a coating on the pigment particles and has a poor solubility in said liquid as determined by Test A herein described, and at least one polymer (hereafter called "polymer B") which is chemically linked to the pre-coated polymer A, said polymer B having a good solubility in said liquid as determined by Test B herein described.

2. A developer composition according to claim 1, wherein polymer A contains structural units derived from monomers being non-solvatable by the carrier liquid and belonging to the the following group:

(a) ethylenically unsaturated carboxylic acid esters having in the ester group $C_1$–$C_4$ alkyl, $C_1$–$C_4$ haloalkyl, $C_1$–$C_4$ alkoxyalkyl, $C_1$–$C_4$ acylalkyl, $C_1$–$C_4$ cyanoalkyl, aralkyl, or an aryl group;
(b) ethylenically unsaturated carbonitriles,
(c) ethylenically unsaturated carbonamides,
(d) halogenated aliphatically unsaturated hydrocarbons,
(e) styrene, methylstyrene, methoxystyrene and halogenated styrene,
(f) vinyl alkyl ethers having from 1 to 4 carbon atoms in the alkyl group;
(g) vinyl ketones having an alkyl group of at most 4 carbon atoms,
(h) vinyl alcohol esters of aliphatic, araliphatic, aromatic or heterocyclic acids wherein alkyl, if present, is $C_1$–$C_4$ alkyl,
(i) vinyl acetals, and
(j) N-vinyl pyrrolidinone.

3. A developer composition according to claim 1, wherein polymer B contains structural units derived from monomers being solvatable by the carrier liquid and belong to the the following group:
(a) alkylstyrenes having from 3 to 10 carbon atoms in the alkyl group,
(b) alkoxystyrenes having from 3 to 10 carbon atoms in the alkyl group,
(c) alkyl acrylates and methacrylates having from 8 to 22 carbon atoms in the alkyl group,
(d) vinyl alkyl ethers having from 8 to 22 carbon atoms in the alkyl group,
(e) vinyl esters of alkanoic acids having from 6 to 22 carbon atoms in the alkyl group, and
(f) alkyl substituted polysiloxanes.

4. A developer composition according to claim 1, wherein at least one structural unit of polymers A and B contains a chemically reactive group capable of addition, elimination or condensation reaction.

5. A developer composition according to claim 4, wherein said chemically reactive groups belong to one of the following categories:
(a) an alkaline primary, secondary or tertiary amino group or quaternary ammonium base group,
(b) a carboxylic acid, sulphonic acid or phosphonic acid group,
(c) an epoxy group,
(d) an isocyanate group,
(e) an acid halide group,
(f) an acid anhydride group,
(g) a hydroxy or thiol group,
(h) an alkyl halide group,
(i) an active methylene group,
(j) a ketone or aldehyde group,
(k) an oxime group,
(l) an hydroxamic acid group, or
(m) a chloroformiate group.

6. A developer composition according to claim 5, wherein at least one said alkaline group (a) is present in structural polymer units derived from one of the following monomers:
tert.-butylaminoethyl methacrylate,
N,N-dialkylaminoethyl acrylate,
N,N-dialkylaminoethyl methacrylate,
dimethylaminopropyl methacrylamide,
methacrylamido-n-propylene-trimethylammonium hydroxide, and vinyl pyridine.

7. A developer composition according to claim 5, wherein at least one said acidic group (b) is present in structural polymer units derived from one of the following monomers:
acrylamido-hydroxyacetic acid,
acrylic acid,
methacrylic acid,
carboxyethyl acrylate,
crotonic acid,
itaconic acid,
vinyl benzoic acid,
vinylphenylacetic acid,
9(10)-acrylamidostearic acid,
monoallylphthalic acid,
sulphoethyl(meth)acrylate,
sulphopropyl(meth)acrylate,
sulphobutyl(meth)acrylate,
acrylamido-2-propane-sulphonic acid,
vinyl sulphonic acid, and
styrenesulphonic acid.

8. A developer composition according to claim 1, wherein the carrier liquid is a hydrocarbon liquid.

9. A developer composition according to claim 1, wherein the pigment particles consist of or contain carbon black or a pigment dye.

10. A developer composition according to claim 1, wherein an oil-soluble ionogenic substance conferring electric charges on said particles is present.

11. A developer composition according to claim 10, wherein said ionogenic substance is a bivalent or trivalent metal salt of:
(a) a monoester or diester of an oxyacid derived from phosphorus,
(b) an oxyacid derived from phosphorus and containing one or two organic groups linked to the phosphorus atom by a carbon atom, or
(c) an oxyacid derived from phosphorus and containing an ester group and an organic group linked by a carbon atom to the phosphorus atom, said organic group being aliphatic, cycloaliphatic or aromatic.

* * * * *